US009133715B2

(12) United States Patent
Lutjen et al.

(10) Patent No.: US 9,133,715 B2
(45) Date of Patent: Sep. 15, 2015

(54) STRUCTURAL MEMBERS IN A PEDESTAL ARRAY

(75) Inventors: Paul M. Lutjen, Kennebunkport (ME); Gary L. Grogg, South Berwick (ME)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 2074 days.

(21) Appl. No.: 11/524,541

(22) Filed: Sep. 20, 2006

(65) Prior Publication Data

US 2010/0226762 A1 Sep. 9, 2010

(51) Int. Cl.

| | |
|---|---|
| ***F01D 5/18*** | (2006.01) |
| ***F01D 11/08*** | (2006.01) |
| ***F01D 25/12*** | (2006.01) |
| ***F23R 3/00*** | (2006.01) |

(52) U.S. Cl.

CPC ..... *F01D 5/187* (2013.01); *F01D 11/08* (2013.01); *F01D 25/12* (2013.01); *F23R 3/005* (2013.01); *F05D 2250/70* (2013.01); *F05D 2260/201* (2013.01); *F05D 2260/202* (2013.01); *F05D 2260/2214* (2013.01)

(58) Field of Classification Search

CPC ..... F01D 5/187; F01D 11/08; F01D 25/12; F23R 3/005; F05D 2250/70; F05D 2260/201; F05D 2260/202; F05D 2260/2214

USPC ..... 415/173.1, 116; 416/96 A, 97 A, 97 R; 165/109.1, 169

See application file for complete search history.

(56) References Cited

U.S. PATENT DOCUMENTS

| | | | | |
|---|---|---|---|---|
| 3,383,093 | A | 5/1968 | Howald | |
| 3,819,295 | A * | 6/1974 | Hauser et al. | 416/97 R |
| 3,864,199 | A * | 2/1975 | Meginnis | 428/596 |
| 4,515,523 | A | 5/1985 | North et al. | |
| 4,768,700 | A * | 9/1988 | Chen | 228/159 |
| 4,775,296 | A * | 10/1988 | Schwarzmann et al. | 416/97 R |
| 5,370,499 | A * | 12/1994 | Lee | 416/97 R |
| 5,649,806 | A * | 7/1997 | Scricca et al. | 415/115 |
| 6,179,565 | B1 * | 1/2001 | Palumbo et al. | 416/97 R |
| 6,231,307 | B1 * | 5/2001 | Correia | 416/97 R |
| 6,254,334 | B1 * | 7/2001 | LaFleur | 415/115 |
| 6,379,528 | B1 * | 4/2002 | Lee et al. | 205/640 |
| 6,402,470 | B1 * | 6/2002 | Kvasnak et al. | 416/97 R |
| 6,514,042 | B2 * | 2/2003 | Kvasnak et al. | 416/97 R |
| 6,824,352 | B1 * | 11/2004 | Moore et al. | 415/115 |
| 6,929,451 | B2 * | 8/2005 | Gregg et al. | 416/96 R |
| 7,011,502 | B2 * | 3/2006 | Lee et al. | 416/97 R |
| 7,033,140 | B2 * | 4/2006 | Gregg | 416/135 |
| 7,097,425 | B2 * | 8/2006 | Cunha et al. | 416/97 R |
| 7,121,787 | B2 * | 10/2006 | Jacks et al. | 415/115 |
| 7,125,225 | B2 * | 10/2006 | Surace et al. | 416/96 R |

(Continued)

FOREIGN PATENT DOCUMENTS

| | | |
|---|---|---|
| EP | 0140257 A1 | 5/1985 |
| EP | 1091092 A2 | 4/2001 |
| EP | 1640563 A2 | 3/2006 |

*Primary Examiner* — Edward Look
*Assistant Examiner* — Aaron R Eastman
(74) *Attorney, Agent, or Firm* — Bachman & LaPointe, P.C.

(57) ABSTRACT

A turbine engine component has a flow path wall and a support wall. The turbine engine component has at least one cooling compact heat exchanger. Each cooling compact heat exchanger has a pedestal array and at least one structural member within the pedestal array for preventing modal crossing in operation range, for preventing panel bulging, and/or for connecting the flow path wall to at least one outer diameter support structure.

11 Claims, 3 Drawing Sheets

(56) References Cited

U.S. PATENT DOCUMENTS

| | | | | |
|---|---|---|---|---|
| 7,296,973 | B2 * | 11/2007 | Lee et al. | 416/97 R |
| 7,438,527 | B2 * | 10/2008 | Albert et al. | 416/97 R |
| 7,478,994 | B2 * | 1/2009 | Cunha et al. | 416/97 R |
| 7,553,128 | B2 * | 6/2009 | Abdel-Messeh et al. | 415/173.1 |
| 2002/0021966 | A1 * | 2/2002 | Kvasnak et al. | 416/97 R |
| 2005/0135933 | A1 * | 6/2005 | Gregg et al. | 416/108 |
| 2005/0135935 | A1 * | 6/2005 | Gregg | 416/135 |
| 2005/0169754 | A1 * | 8/2005 | Surace et al. | 416/97 R |
| 2006/0060334 | A1 | 3/2006 | Joe et al. | |
| 2006/0140753 | A1 * | 6/2006 | Romanov et al. | 415/173.1 |
| 2006/0239819 | A1 * | 10/2006 | Albert et al. | 416/97 R |
| 2007/0248462 | A1 * | 10/2007 | Lutjen et al. | 416/95 |
| 2008/0063524 | A1 * | 3/2008 | Tibbott | 416/95 |
| 2008/0089787 | A1 * | 4/2008 | Abdel-Messeh et al. | 416/179 |
| 2008/0095636 | A1 * | 4/2008 | Cherolis et al. | 416/97 R |

* cited by examiner

STRUCTURAL MEMBERS IN A PEDESTAL ARRAY

STATEMENT OF GOVERNMENT INTEREST

The Government of the United States of America may have rights in the present invention as a result of Contract No. N00019-02-C-3003 awarded by the Department of the Navy.

BACKGROUND (1) Field of the Invention

The present invention relates to structural members for use in cooling compact heat exchangers used in turbine engine components.

(2) Prior Art

Compact heat exchanger arrays are used in a wide variety of turbine engine components to effect cooling of the components. Many such compact heat exchangers include arrays of pedestals. To make efficient use of compact heat exchanger pedestal arrays, cavities are created with substantial distances between inlets and exits and between side walls of the array. The pedestals within these arrays may be susceptible to fracture at temperature and deflections under operation. With time, this could lead to the hot wall bulging into the flow path due to pressure loads and temperatures. Additionally, the unsupported panel might have vibrational natural frequencies that coincide with engine forcing functions during operation, which could lead to high cycle fatigue.

SUMMARY OF THE INVENTION

In accordance with the present invention, there are provided structural members for pedestals arrays which alleviate the foregoing problems.

The present invention is directed to a turbine engine component having a flow path wall and a support wall. The turbine engine component broadly comprises at least one cooling compact heat exchanger. Each compact heat exchanger has a pedestal array and at least one structural member within the pedestal array for preventing modal crossing in operation range for preventing panel bulging, and/or for connecting the flow path wall to outer diameter support structures. The term "modal crossing" refers to a coincidence of the natural frequencies of the turbine engine component with a forcing function of the engine at operational conditions. It drives oscillations of part features and may lead to premature cyclic failure.

Other details of the structural members in a pedestal array of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
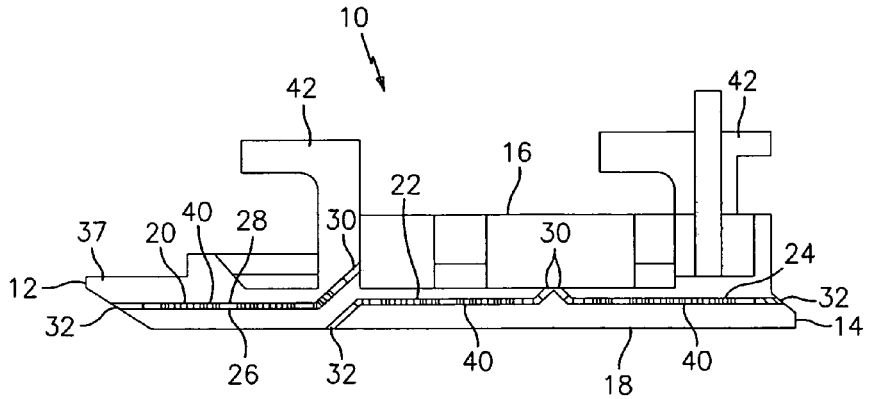
FIG. 1 is a sectional view of a turbine engine component.

Referring now to the drawings, FIG. 1 illustrates a turbine engine component 10 such as a blade outer air seal. The turbine engine component has a leading edge 12 and a trailing edge 14. The component 10 also has an outer diameter 16 and an inner diameter 18.

To effect cooling of the component 10, a plurality of compact heat exchangers is embedded within the component. The compact heat exchangers may include a leading edge compact heat exchanger 20, a main body compact heat exchanger 22, and a trailing edge compact heat exchanger 24. Each of the compact heat exchangers 20, 22, and 24 has a flow path wall 26 and a support wall 28. The flow path wall 26 is the hot wall while the support wall 28 is the cold wall. Still further, each of the compact heat exchangers has a plurality of inlets 30 for a cooling fluid and a plurality of outlets 32.

Figure 2:
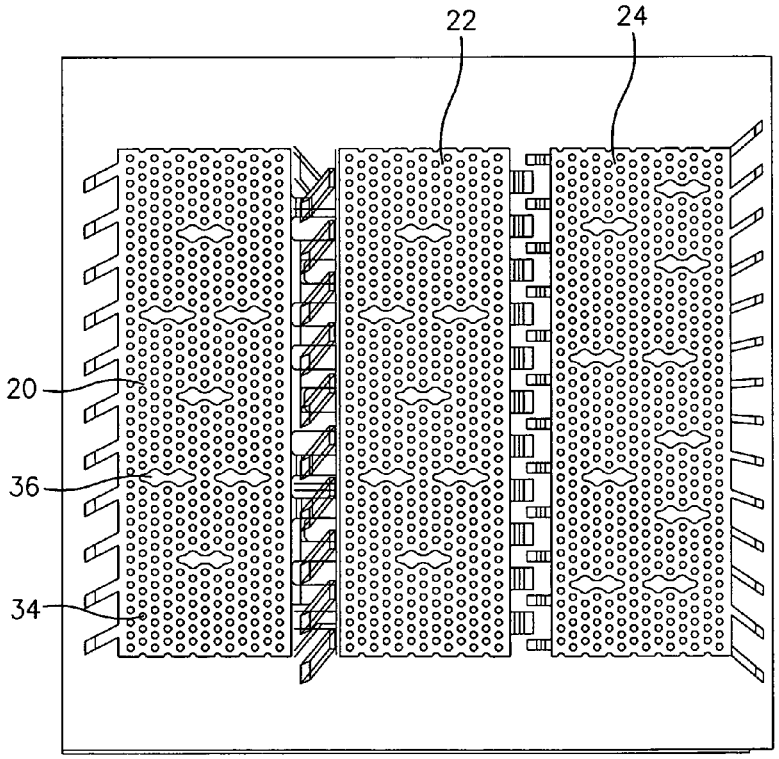
FIG. 2 is a sectional view of the turbine engine component of FIG. 1.
Figure 3:
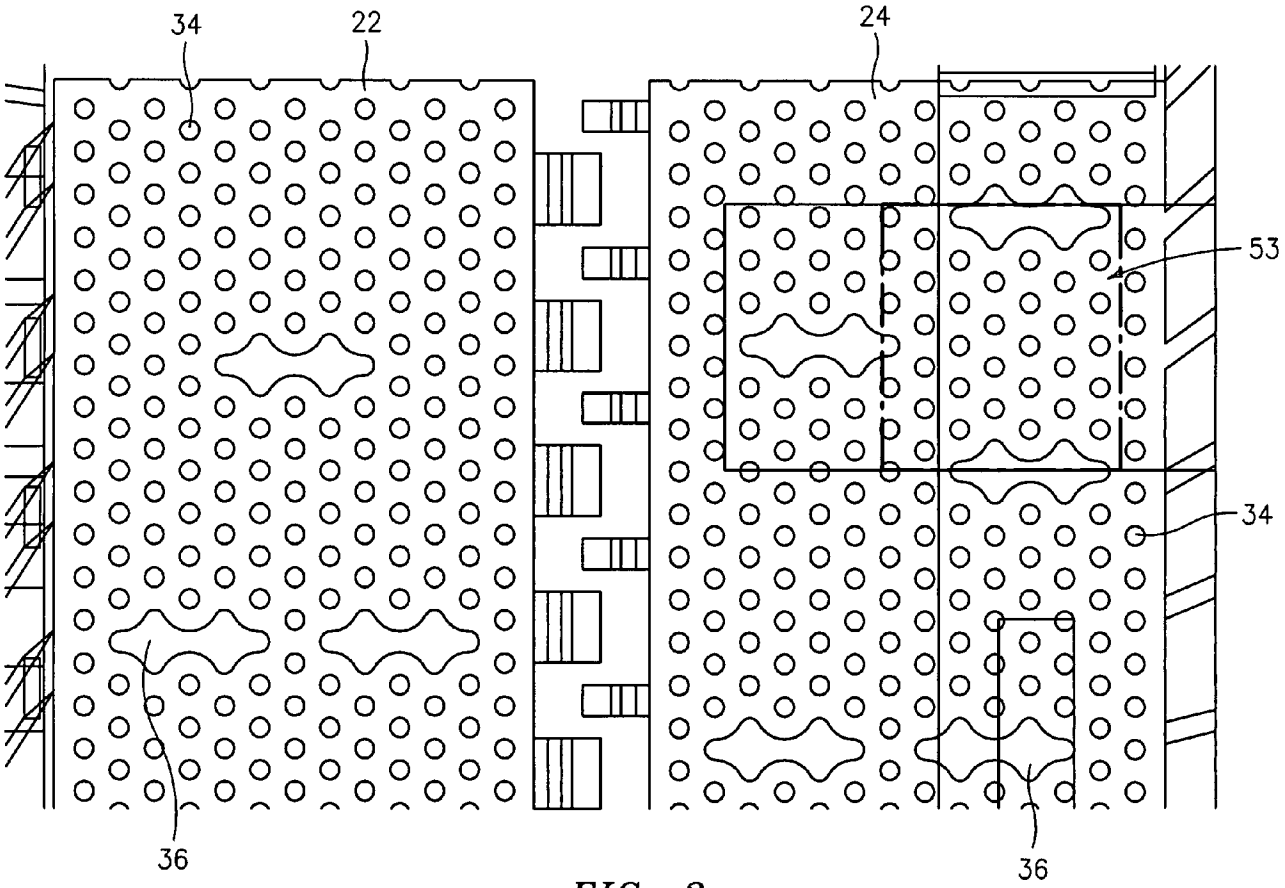
FIG. 3 is an enlarged view of a portion of the turbine engine component of FIG. 2.
Figure 4:
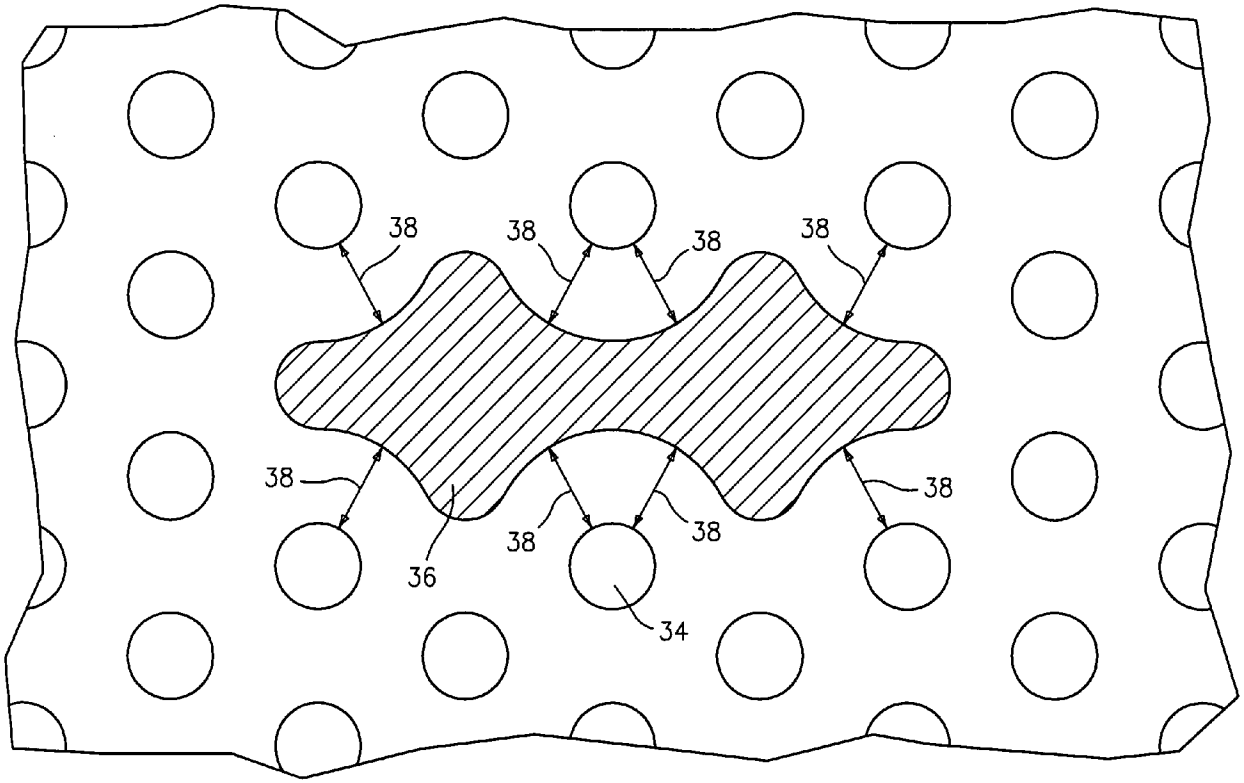
FIG. 4 illustrates the gaps between a structural member and the pedestals surrounding the structural members.

As shown in FIGS. 2-4, within each of the circuits 20, 22, and 24, there are a plurality of pedestals 34. The pedestals 34 create turbulence within each heat exchanger and thereby improve the heat transfer characteristics of the heat exchanger. The pedestals 34 may have any desired shape. For example, each of the pedestals 34 could be cylindrical in shape. Still further each of the pedestals 34 may be multi-sided, such as having seven sides.

Embedded within each of the compact heat exchangers 20, 22 and 24 are a plurality of structural members 36. Each of the structural members 36 is designed to unite a plurality of pedestals into a larger viable cluster. For example, each of the structural members may unite from 4 to 7 pedestals. Each structural member 36 is dimensioned such that a minimum flow area 38 is maintained between the structural member 36 and the surrounding pedestals 34. Each structural member 36 is preferably a cast structure made from the same material as that from which the turbine engine component is made.

The structural members 36 may be positioned within the pedestal array in each of the compact heat exchangers 20, 22, and 24 at discrete locations to prevent modal crossing in operation range and prevent panel bulging. Further, each of the structural members 36 has a height sufficient to connect the inner diameter hot wall 26 with the outer diameter wall 28 which is connected to one or more outer diameter support structures such as the OD plate 37 located outboard of the core passages 40. The attachment features 42 may be joined to the plate 37. For example, dotted line area 53 in FIG. 3 outlines one such area of intersection between features 42 and 37.

If desired, a plurality of structural members 36 may be positioned in an aligned configuration (see FIGS. 2 and 3) in the same rows of pedestals 34. Each of the structural members 36 comprises a merger of multiple pedestals and may have any desired shape. For example, the structural members 36 may have a polygonal shape with as many sides as necessary for joining a desired number of the pedestals 34.

The structural members 36, when compared to a pedestal array, provide a more robust connection between the flow path wall 26 to the support structure of the component 10 in order to prevent bulging (creep) of the flow path wall 26. The structural members 36 also prevent modal crossings in the operating range, particularly in the blade rubtrack where the blade passing is a potential forcing function.

While the turbine engine component 10 has been described as being a blade outer air seal, it could also be a blade or a vane. The structural members could be used in any cooling compact heat exchangers in any turbine engine component.

While the turbine engine component 10 has been described as having a plurality of cooling compact heat exchangers, the component can have fewer, such as one cooling compact heat exchanger, or more than three cooling compact heat exchangers.

It is apparent that there has been provided in accordance with the present invention structural members in a pedestal array which fully satisfy the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component having a flow path wall and a support wall, said turbine engine component comprising:

a plurality of discrete cooling compact heat exchangers embedded within said turbine engine component; and each of said cooling compact heat exchangers having a pedestal array comprising a plurality of pedestals and means within said pedestal array for preventing modal crossing in operation range and for preventing panel bulging, wherein said modal crossing and panel bulging preventing means further comprises means for connecting said flow path wall with at least one outer diameter support structure, wherein said modal crossing and panel bulging preventing means comprises at least one structural member comprising a merger of multiple pedestals and having a non U-shaped polygonal shape, and wherein each said structural member is surrounded on all sides by at least one of said pedestals.

2. The turbine engine component according to claim 1, wherein each of said structural members has a multi-sided shape and extends between an inner wall and an outer wall.

3. The turbine engine component according to claim 1, wherein each of said structural members extends between an inner wall and an outer wall.

4. The turbine engine component according to claim 1, wherein each said structural member is dimensioned so that a minimum flow area is maintained between the structural member and a surrounding array of pedestals.

5. The turbine engine component according to claim 1, wherein said modal crossing and panel bulging preventing means comprises a plurality of structural members dispersed throughout said pedestal array and each of said structural members joining a plurality of pedestals.

6. A turbine engine component having a flow path wall and a support wall, said turbine engine component comprising:

at least one cooling compact heat exchanger; and said at least one cooling compact heat exchanger having a pedestal array comprising a plurality of columns and a plurality of rows of pedestals and means within said pedestal array for connecting said flow path wall with at least one outer diameter support structure, said connecting means comprising at least one non U-shaped structural member which has a longitudinal axis and a length greater than a span of at least three adjacent ones of said columns of pedestals in a direction parallel to said longitudinal axis and which has a width in at least one portion which spans two rows of said pedestals.

7. The turbine engine component according to claim 6, wherein each of said structural members has a multi-sided shape and extends between said flow path wall and said support wall.

8. The turbine engine component according to claim 6, wherein each of said structural members extends between said flow path wall and said support wall.

9. The turbine engine component according to claim 6, wherein said at least one structural member unites a plurality of said pedestals.

10. The turbine engine component according to claim 9, wherein each said structural member is dimensioned so that a minimum flow area is maintained between the structural member and a surrounding array of pedestals.

11. The turbine engine component according to claim 6, wherein said connecting means comprises a plurality of structural members dispersed throughout said pedestal array and each of said structural members unites a plurality of pedestals.

* * * * *